US009728125B2

(12) United States Patent
Li et al.

(10) Patent No.: US 9,728,125 B2
(45) Date of Patent: Aug. 8, 2017

(54) AMOLED PIXEL CIRCUIT

(71) Applicant: Shenzhen China Star Optoelectronics Technology Co., Ltd., Shenzhen, Guangdong (CN)

(72) Inventors: Wenhui Li, Guangdong (CN); Chihyuan Tseng, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 176 days.

(21) Appl. No.: 14/424,429

(22) PCT Filed: Feb. 9, 2015

(86) PCT No.: PCT/CN2015/072549

§ 371 (c)(1),
(2) Date: Feb. 26, 2015

(87) PCT Pub. No.: WO2016/101394

PCT Pub. Date: Jun. 30, 2016

(65) Prior Publication Data

US 2016/0343299 A1 Nov. 24, 2016

(30) Foreign Application Priority Data

Dec. 22, 2014 (CN) ..... 2014 1 0810774

(51) Int. Cl.
*G09G 3/3233* (2016.01)

(52) U.S. Cl.
CPC ... *G09G 3/3233* (2013.01); *G09G 2300/0842* (2013.01); *G09G 2310/0262* (2013.01);
(Continued)

(58) Field of Classification Search
CPC ..... G09G 3/3233; G09G 2300/0819; G09G 2320/0233; G09G 2320/041;
(Continued)

(56) References Cited

U.S. PATENT DOCUMENTS

2002/0125831 A1* 9/2002 Inukai ..... G09G 3/3266 315/169.3
2009/0160740 A1* 6/2009 Leon ..... G09G 3/3291 345/76

(Continued)

FOREIGN PATENT DOCUMENTS

CN 103681772 A 3/2014

*Primary Examiner* — Dmitriy Bolotin
(74) *Attorney, Agent, or Firm* — Andrew C. Cheng

(57) ABSTRACT

The present invention provides an AMOLED pixel circuit. The third thin film transistor (T3) are located between the first, the second thin film transistors (T1, T2), and the control line (Control) is employed to input the control signal for controlling on and off of the third thin film transistor (T3), and thus controlling the AMOLED pixel circuit to measure the drive current with the current measurement circuit (1) and correcting the signal voltage with the signal voltage drive circuit (2), or displaying normally. The drive current entering the organic light emitting diode (D) in respective pixels can be corrected to solve the issues of unstable brightness and uneven display caused by the properties of the organic light emitting diode (D), which is changing along with the time and temperature, and to improve the display effect.

11 Claims, 2 Drawing Sheets

(52) U.S. Cl.
CPC ..... *G09G 2320/0233* (2013.01); *G09G 2320/0295* (2013.01); *G09G 2320/041* (2013.01); *G09G 2320/045* (2013.01); *G09G 2320/0693* (2013.01)

(58) Field of Classification Search
CPC ..... G09G 2320/045; G09G 2330/12; G09G 2300/0842; G09G 2310/0262; G09G 2320/0295; G09G 2320/0693
USPC ..... 345/214; 315/169.3
See application file for complete search history.

(56) References Cited

U.S. PATENT DOCUMENTS

2010/0123699 A1* 5/2010 Leon ..... G09G 3/3233 345/211
2010/0220091 A1* 9/2010 Choi ..... G09G 3/3208 345/213
2010/0225630 A1* 9/2010 Levey ..... G09G 3/3233 345/211
2012/0064643 A1* 3/2012 Bawolek ..... G09G 3/006 438/16
2012/0306840 A1* 12/2012 Han ..... G09G 3/003 345/212
2014/0062331 A1* 3/2014 Nam ..... G09G 3/3233 315/226
2014/0340432 A1* 11/2014 Chaji ..... G09G 3/3233 345/690
2015/0130866 A1* 5/2015 Bae ..... G09G 3/3225 345/694
2016/0035281 A1* 2/2016 Jeon ..... G09G 3/3225 345/690
2016/0125796 A1* 5/2016 Ohara ..... G09G 3/30 345/211
2016/0148578 A1* 5/2016 Kishi ..... G09G 3/3233 345/212

* cited by examiner

AMOLED PIXEL CIRCUIT

FIELD OF THE INVENTION

The present invention relates to a display technology field, and more particularly to an AMOLED pixel circuit.

BACKGROUND OF THE INVENTION

The flat panel display devices possess many merits of thin frame, power saving, no radiation, etc. and have been widely used. Present flat panel display devices mainly comprise a LCD (Liquid Crystal Display) or an OLED (Organic Light Emitting Display).

An OLED possesses many outstanding properties of self-illumination, no requirement of backlight, high contrast, ultra-thin, wide view angle, fast response, applicability of flexible panel, wide range of working temperature, simpler structure and process, and, therefore is considered as a "dream display". It has been favored by respective big display makers and has become the main selection of the third generation display element.

The OLED can be categorized into two major types according to their driving types, which are Passive matrix OLED (PMOLED) and Active matrix OLED (AMOLED), i.e. the direct addressing and the Thin Film Transistor (TFT) matrix addressing. The power consumption of the PMOLED is high, and thus, it hinders the application in large scale display devices. Therefore, the PMOLED is generally applied for the small scale display devices. The lighting efficiency of the AMOLED is high, and therefore, it is generally utilized for the large scale display devices of high resolution.

FIG. 1 shows a circuit diagram of an AMOLED pixel circuit according to prior art. In the display area of the AMOLED display device, the pixels are arranged in an array comprising multiple rows, multiple columns. Each pixel generally utilizes a pixel circuit comprising two thin film transistors and one capacitor for performing driving, i.e. the 2T1C driving. The gate of the first thin film transistor T1 is electrically connected to the scan line Scan, and the source is electrically connected to the signal line Data, and the drain is electrically coupled to the gate of the second thin film transistor T2 and one end of a capacitor C; the source of the second thin film transistor T2 is electrically connected to the power source line VDD, and the drain is electrically connected to the anode of the organic light emitting diode D; the cathode of the organic light emitting diode D is electrically connected to the common ground electrode VSS; one end of the capacitor C is electrically connected to the drain of first thin film transistor T1, and the other end is electrically connected to the source of second thin film transistor T2. As displaying, the scan line Scan controls the first thin film transistor T1 to be on, and the signal voltage of the signal line Data enters the gate of the second thin film transistor T2 and the capacitor C via the first thin film transistor T1, and then the first thin film transistor T1 is off. With the function of capacitor C, the gate voltage of the second thin film transistor T2 still can keep the signal voltage to allow the second thin film transistor T2 to be in an on state, and the drive current corresponded with the power source line VDD and the signal voltage enters the organic light emitting diode D via the second thin film transistor T2 to drive the organic light emitting diode D to illuminate.

The aforesaid AMOLED display device is current driving. However, the lifetime of the organic light emitting diode D is not stable, and the properties of the organic light emitting diode D is changing along with the time and temperature, which can make the current flowing through the organic light emitting diode D change. The brightness can be changed thereby, and the change conditions of the respective pixels are different. Thus, the issue of uneven display happens.

SUMMARY OF THE INVENTION

The present invention provides an AMOLED pixel circuit, of which the drive current entering the organic light emitting diode in respective pixels can be corrected to solve the issues of unstable brightness and uneven display caused by the properties of the organic light emitting diode, which is changing along with the time and temperature.

For realizing the aforesaid objective, the present invention provides an AMOLED circuit, comprising:

a first thin film transistor, and a gate of the first thin film transistor is electrically coupled to a scan line, and a source is electrically coupled to a signal line, and a drain is electrically coupled to a source of a third thin film transistor and one end of a capacitor;

the third thin film transistor, and a gate of the third thin film transistor is electrically coupled to a control line, and the source is electrically coupled to the drain of the first thin film transistor, and a drain is electrically coupled to a gate of a second thin film transistor;

the second thin film transistor, and the gate of the second thin film transistor is electrically coupled to the drain of the third thin film transistor, a source is electrically coupled to a power source line, and a drain is electrically coupled to an anode of an organic light emitting diode;

the capacitor, and one end of the capacitor is electrically coupled to the drain of the first thin film transistor, and the other end is electrically coupled to the source of the second thin film transistor;

the organic light emitting diode, and the anode of the organic light emitting diode is electrically coupled to the drain of the second thin film transistor, and a cathode is electrically coupled to a common ground electrode;

a current measurement circuit, and one end of the current measurement circuit is electrically coupled to the power source line, and the other end is electrically coupled to a signal voltage drive circuit; and the signal voltage drive circuit, and one end of the signal voltage drive circuit is electrically coupled to the current measurement circuit, and the other end is electrically coupled to the signal line.

The scan line is employed to input a scan signal for controlling on and off of the first thin film transistor.

The signal line is employed to input a signal voltage for controlling a value of drive current entering the organic light emitting diode.

The control line is employed to input a control signal for controlling on and off of the third thin film transistor, and thus controlling the AMOLED pixel circuit to measure the drive current and correcting the signal voltage or displaying.

The current measurement circuit is employed to measure a drive current, and feedbacks a measurement result to the signal voltage drive circuit.

The signal voltage drive circuit is employed to correct a signal voltage according to a measurement result received from the current measurement circuit, and deliver the corrected signal voltage to the signal line.

As the driving current is relatively smaller than a normal value, the signal voltage drive circuit correspondingly corrects and raises the signal voltage; as the driving current is relatively larger than the normal value, the signal voltage drive circuit correspondingly corrects and reduces the signal voltage.

A drive current measurement and a signal voltage correction of the AMOLED pixel circuit are performed once before each frame or after each frame, or are performed once or more in each image display period, or are performed once as starting up, or are performed once for each regular duration.

The drive current measurement and the signal voltage correction of the AMOLED pixel circuit are performed row by row.

Each column of pixels corresponds to one current measurement circuit.

The present invention further provides an AMOLED circuit, comprising:

a first thin film transistor, and a gate of the first thin film transistor is electrically coupled to a scan line, and a source is electrically coupled to a signal line, and a drain is electrically coupled to a source of a third thin film transistor and one end of a capacitor;

the third thin film transistor, and a gate of the third thin film transistor is electrically coupled to a control line (Control), and the source is electrically coupled to the drain of the first thin film transistor, and a drain is electrically coupled to a gate of a second thin film transistor;

the second thin film transistor, and the gate of the second thin film transistor is electrically coupled to the drain of the third thin film transistor, a source is electrically coupled to a power source line, and a drain is electrically coupled to an anode of an organic light emitting diode;

the capacitor, and one end of the capacitor is electrically coupled to the drain of the first thin film transistor, and the other end is electrically coupled to the source of the second thin film transistor;

the organic light emitting diode, and the anode of the organic light emitting diode is electrically coupled to the drain of the second thin film transistor, and a cathode is electrically coupled to a common ground electrode;

a current measurement circuit, and one end of the current measurement circuit is electrically coupled to the power source line, and the other end is electrically coupled to a signal voltage drive circuit; and the signal voltage drive circuit, and one end of the signal voltage drive circuit is electrically coupled to the current measurement circuit, and the other end is electrically coupled to the signal line;

wherein the scan line is employed to input a scan signal for controlling on and off of the first thin film transistor;

wherein the signal line is employed to input a signal voltage for controlling a value of drive current entering the organic light emitting diode;

wherein the control line is employed to input a control signal for controlling on and off of the third thin film transistor, and thus controlling the AMOLED pixel circuit to measure the drive current and correcting the signal voltage or displaying;

wherein the current measurement circuit is employed to measure a drive current, and feedbacks a measurement result to the signal voltage drive circuit;

wherein the signal voltage drive circuit is employed to correct a signal voltage according to a measurement result received from the current measurement circuit, and deliver the corrected signal voltage to the signal line.

The benefits of the present invention are: the present invention provides an AMOLED pixel circuit. The third thin film transistor are located between the first, the second thin film transistors, and the control line is employed to input the control signal for controlling on and off of the third thin film transistor, and thus controlling the AMOLED pixel circuit to measure the drive current with the current measurement circuit and correcting the signal voltage with the signal voltage drive circuit, or displaying normally. The drive current entering the organic light emitting diode in respective pixels can be corrected to solve the issues of unstable brightness and uneven display caused by the properties of the organic light emitting diode, which is changing along with the time and temperature, and to improve the display effect.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
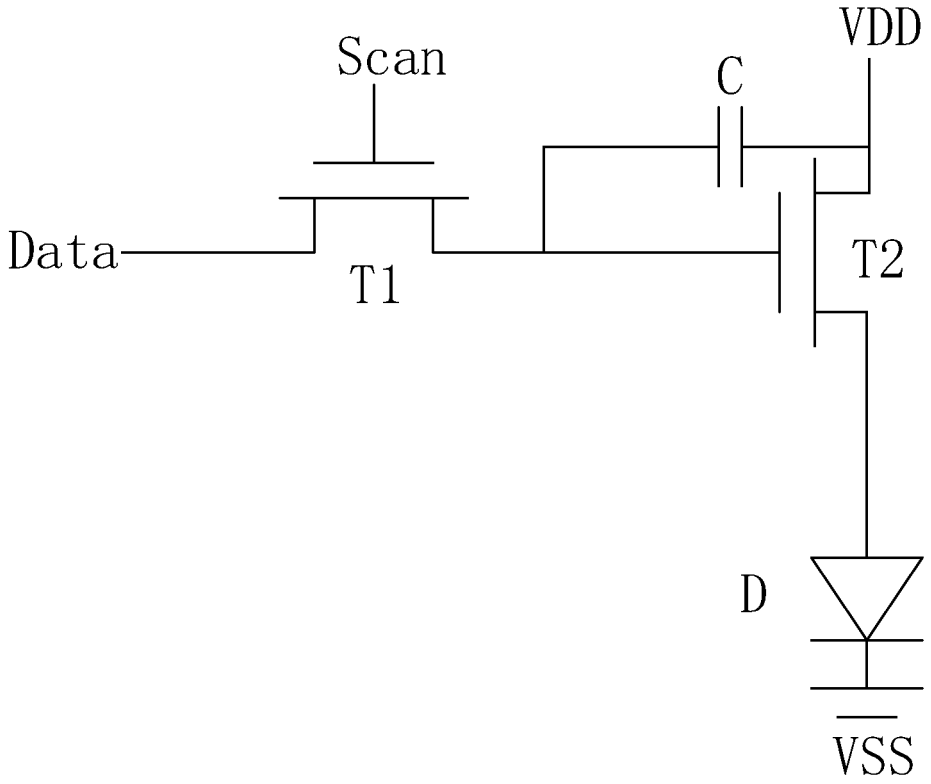
FIG. 1 is a circuit diagram of an AMOLED pixel circuit according to prior art.
Figure 2:
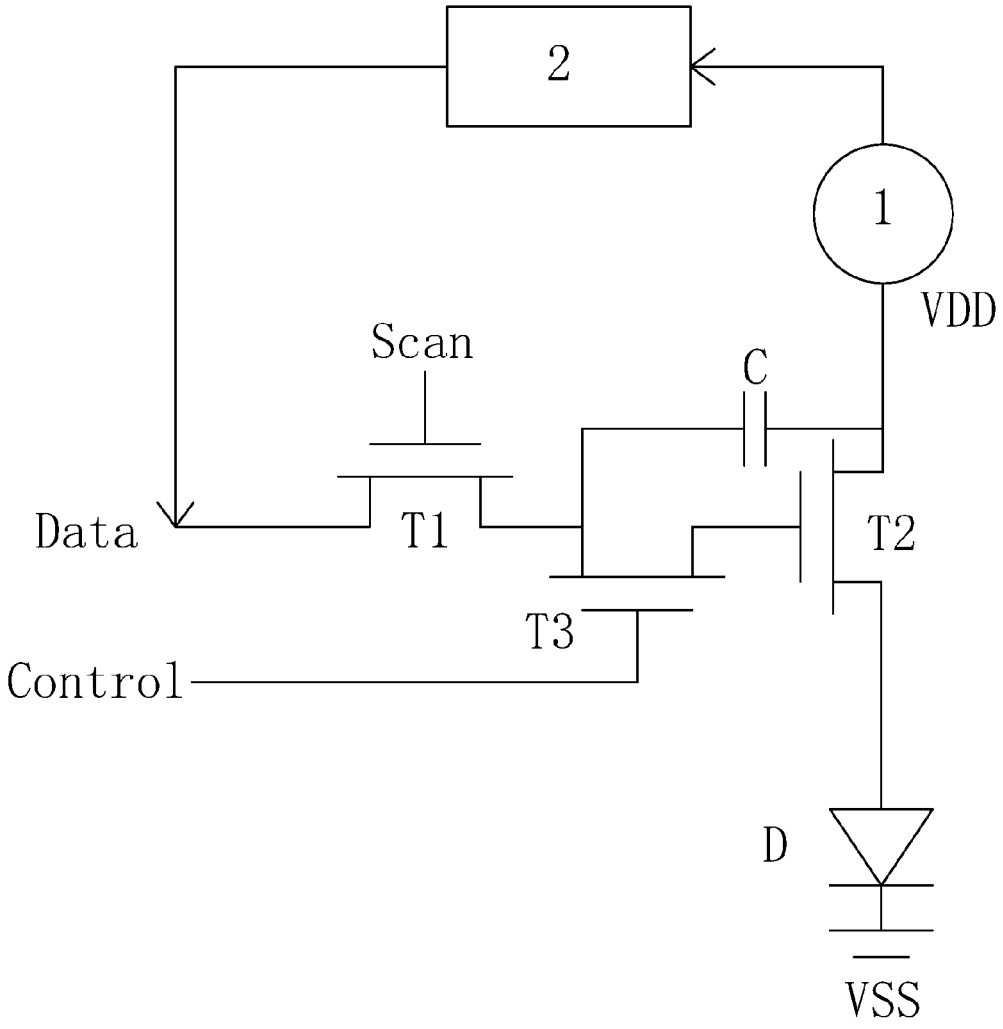
FIG. 2 is a circuit diagram of an AMOLED pixel circuit according to present invention.

Please refer to FIG. 2. The present invention provides an AMOLED pixel circuit, comprising:

a first thin film transistor T1, and a gate of the first thin film transistor T1 is electrically coupled to a scan line Scan, and a source is electrically coupled to a signal line Data, and a drain is electrically coupled to a source of a third thin film transistor T3 and one end of a capacitor C;

the third thin film transistor T3, and a gate of the third thin film transistor T3 is electrically coupled to a control line Control, and the source is electrically coupled to the drain of the first thin film transistor T1, and a drain is electrically coupled to a gate of a second thin film transistor T2;

the second thin film transistor T2, and the gate of the second thin film transistor T2 is electrically coupled to the drain of the third thin film transistor T3, a source is electrically coupled to a power source line VDD, and a drain is electrically coupled to an anode of an organic light emitting diode D;

the capacitor C, and one end of the capacitor C is electrically coupled to the drain of the first thin film transistor T1, and the other end is electrically coupled to the source of the second thin film transistor T2;

the organic light emitting diode D, and the anode of the organic light emitting diode D is electrically coupled to the drain of the second thin film transistor T2, and a cathode is electrically coupled to a common ground electrode VSS;

a current measurement circuit 1, and one end of the current measurement circuit 1 is electrically coupled to the power source line VDD, and the other end is electrically coupled to a signal voltage drive circuit 2; and the signal voltage drive circuit 2, and one end of the signal voltage drive circuit 2 is electrically coupled to the current measurement circuit 1, and the other end is electrically coupled to the signal line Data.

Furthermore, the scan line Scan is employed to input a scan signal for controlling on and off of the first thin film transistor T1. The signal line Data is employed to input a signal voltage for controlling a value of drive current entering the organic light emitting diode D. The control line Control is employed to input a control signal for controlling on and off of the third thin film transistor T3, and thus controlling the AMOLED pixel circuit to measure the drive current and correcting the signal voltage or displaying. The current measurement circuit 1 is employed to measure a drive current, and feedbacks a measurement result to the signal voltage drive circuit 2. The signal voltage drive circuit 2 is employed to correct a signal voltage according to a measurement result received from the current measurement circuit 1, and deliver the corrected signal voltage to the signal line Data.

Specifically, the working procedure of the AMOLED pixel circuit according to the present invention comprises stages of:

A, Drive Current Measurement and Signal Voltage Correction Stage

First, the scan line Scan inputs a high voltage level to the gate of the first thin film transistor T1 to control the first thin film transistor T1 to be on, and synchronously, the control line Control inputs a low voltage level to the gate of the third thin film transistor T3 to control the third thin film transistor T3 to be off, and the signal voltage of the signal line Data is entered and stored in the capacitor C via the first thin film transistor T1, and at this moment, because the third thin film transistor T3 is not on, the second thin film transistor T2 is not on, and the organic light emitting diode D has no current to flow through, and is not illuminating. Then, the scan line Scan inputs a low voltage level to the gate of the first thin film transistor T1 to control the first thin film transistor T1 to be off. After that, the control line Control quickly and successively inputs a high voltage level, a low voltage level to the gate of the third thin film transistor T3 to control the third thin film transistor T3 to be quickly and successively on and off; as the third thin film transistor T3 is on, the second thin film transistor T2 which is controlled by the third thin film transistor T3 is on, accordingly; and the drive current enters into the organic light emitting diode D from the power source line VDD, and meanwhile, the current measurement circuit 1 electrically connected to the power source line VDD measures the drive current, and feedbacks the measurement result to the signal voltage drive circuit 2; the signal voltage drive circuit 2 corrects a signal voltage according to the measurement result received from the current measurement circuit 1, and as the driving current is measured to be relatively smaller than a normal value, the signal voltage drive circuit correspondingly corrects and raises the signal voltage; as the driving current is measured to be relatively larger than the normal value, the signal voltage drive circuit correspondingly corrects and reduces the signal voltage. The corrected signal voltage is delivered to the signal line Data by the signal voltage drive circuit 2.

B, Display Stage

Subsequently, the scan line Scan inputs a high voltage level to the gate of the first thin film transistor T1 to control the first thin film transistor T1 to be on, and synchronously, the control line Control inputs a high voltage level to the gate of the third thin film transistor T3 to control the third thin film transistor T3 to be on, and the corrected signal voltage enters the gate of the second thin film transistor T2 and the capacitor C from the data line Data, and the second thin film transistor T2 remains to be on, and the drive current flows into the organic light emitting diode D from the power source line VDD, and the organic light emitting diode D illuminates. Because the signal voltage is corrected, i.e. the gate voltage of the second thin film transistor T2 is corrected, the drive current entering the organic light emitting diode D via the second thin film transistor T2 can be corrected. Thus, the brightness of the organic light emitting diode D is corrected, accordingly to solve the issues of unstable brightness and uneven display caused by the properties of the organic light emitting diode, which is changing along with the time and temperature, and to improve the display effect.

Significantly, as considering the entire AMOLED display panel, a plurality of pixels are arranged in an array comprising multiple rows, multiple columns. The entire AMOLED display panel can comprise a plurality of current measurement circuits 1. Each column of pixels corresponds to one current measurement circuit 1. That is, the AMOLED pixel circuits in the same column are commonly and electrically connected to one current measurement circuit 1. As the drive current measurement and the signal voltage correction are performed to the entire AMOLED display panel, the scan lines Scan of 1st row to nth row (n is an positive integer larger than 1) sequentially provide the scan signals, and the control lines Control of 1st row to nth row sequentially provide the control signals for performing the drive current measurement and the signal voltage correction row by row. Furthermore, the drive current measurement and the signal voltage correction of the AMOLED pixel circuit are performed once before each frame or after each frame, or are performed once or more in each image display period, or are performed once as starting up, or are performed once for each regular duration. Because the drive current measurement and the signal voltage correction are performed row by row, the organic light emitting diodes D in respective pixels merely illuminate at the moment of measurement, and do not illuminate in the rest time, and the measurement time is shorter, the entire picture is still to be felt like a black picture for human eyes, and the display quality is not influenced.

In conclusion, the present invention provides an AMOLED pixel circuit, the third thin film transistor are located between the first, the second thin film transistors, and the control line is employed to input the control signal for controlling on and off of the third thin film transistor, and thus controlling the AMOLED pixel circuit to measure the drive current with the current measurement circuit and correcting the signal voltage with the signal voltage drive circuit, or displaying normally. The drive current entering the organic light emitting diode in respective pixels can be corrected to solve the issues of unstable brightness and uneven display caused by the properties of the organic light emitting diode, which is changing along with the time and temperature, and to improve the display effect.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. An AMOLED pixel circuit, comprising:

a first thin film transistor, and a gate of the first thin film transistor is electrically coupled to a scan line, and a source is electrically coupled to a signal line, and a drain is electrically coupled to a source of a third thin film transistor and one end of a capacitor;

the third thin film transistor, and a gate of the third thin film transistor is electrically coupled to a control line (Control), and the source is electrically coupled to the drain of the first thin film transistor, and a drain is electrically coupled to a gate of a second thin film transistor;

the second thin film transistor, and the gate of the second thin film transistor is electrically coupled to the drain of the third thin film transistor, a source is electrically coupled to a power source line, and a drain is electrically coupled to an anode of an organic light emitting diode;

the capacitor, and one end of the capacitor is electrically coupled to the drain of the first thin film transistor, and the other end is electrically coupled to the source of the second thin film transistor;

the organic light emitting diode, and the anode of the organic light emitting diode is electrically coupled to the drain of the second thin film transistor, and a cathode is electrically coupled to a common ground electrode;

a current measurement circuit, and one end of the current measurement circuit is electrically coupled to the power source line, and the other end is electrically coupled to a signal voltage drive circuit; and the signal voltage drive circuit, and one end of the signal voltage drive circuit is electrically coupled to the current measurement circuit, and the other end is electrically coupled to the signal line, wherein a drive current measurement and a signal voltage correction of the AMOLED pixel circuit are performed once before each frame or after each frame, or are performed once or more in each image display period, or are performed once as starting up, or are performed once for each regular duration;

wherein the drive current measurement and the signal voltage correction of the AMOLED pixel circuit are performed row by row.

2. The AMOLED pixel circuit according to claim 1, wherein the scan line is employed to input a scan signal for controlling on and off of the first thin film transistor.

3. The AMOLED pixel circuit according to claim 1, wherein the signal line is employed to input a signal voltage for controlling a value of drive current entering the organic light emitting diode.

4. The AMOLED pixel circuit according to claim 1, wherein the control line is employed to input a control signal for controlling on and off of the third thin film transistor, and thus controlling the AMOLED pixel circuit to measure the drive current and correcting the signal voltage or displaying.

5. The AMOLED pixel circuit according to claim 1, wherein the current measurement circuit is employed to measure a drive current, and feedbacks a measurement result to the signal voltage drive circuit.

6. The AMOLED pixel circuit according to claim 1, wherein the signal voltage drive circuit is employed to correct a signal voltage according to a measurement result received from the current measurement circuit, and deliver the corrected signal voltage to the signal line.

7. The AMOLED pixel circuit according to claim 6, wherein as the driving current is relatively smaller than a normal value, the signal voltage drive circuit correspondingly corrects and raises the signal voltage; as the driving current is relatively larger than the normal value, the signal voltage drive circuit correspondingly corrects and reduces the signal voltage.

8. The AMOLED pixel circuit according to claim 1, wherein each column of pixels corresponds to one current measurement circuit.

9. An AMOLED pixel circuit, comprising:

a first thin film transistor, and a gate of the first thin film transistor is electrically coupled to a scan line, and a source is electrically coupled to a signal line, and a drain is electrically coupled to a source of a third thin film transistor and one end of a capacitor;

the third thin film transistor, and a gate of the third thin film transistor is electrically coupled to a control line (Control), and the source is electrically coupled to the drain of the first thin film transistor, and a drain is electrically coupled to a gate of a second thin film transistor;

the second thin film transistor, and the gate of the second thin film transistor is electrically coupled to the drain of the third thin film transistor, a source is electrically coupled to a power source line, and a drain is electrically coupled to an anode of an organic light emitting diode;

the capacitor, and one end of the capacitor is electrically coupled to the drain of the first thin film transistor, and the other end is electrically coupled to the source of the second thin film transistor;

the organic light emitting diode, and the anode of the organic light emitting diode is electrically coupled to the drain of the second thin film transistor, and a cathode is electrically coupled to a common ground electrode;

a current measurement circuit, and one end of the current measurement circuit is electrically coupled to the power source line, and the other end is electrically coupled to a signal voltage drive circuit; and the signal voltage drive circuit, and one end of the signal voltage drive circuit is electrically coupled to the current measurement circuit, and the other end is electrically coupled to the signal line;

wherein the scan line is employed to input a scan signal for controlling on and off of the first thin film transistor;

wherein the signal line is employed to input a signal voltage for controlling a value of drive current entering the organic light emitting diode;

wherein the control line is employed to input a control signal for controlling on and off of the third thin film transistor, and thus controlling the AMOLED pixel circuit to measure the drive current and correcting the signal voltage or displaying;

wherein the current measurement circuit is employed to measure a drive current, and feedbacks a measurement result to the signal voltage drive circuit;

wherein the signal voltage drive circuit is employed to correct a signal voltage according to a measurement result received from the current measurement circuit, and deliver the corrected signal voltage to the signal line, wherein a drive current measurement and a signal voltage correction of the AMOLED pixel circuit are performed once before each frame or after each frame, or are performed once or more in each image display period, or are performed once as starting up, or are performed once for each regular duration;

wherein the drive current measurement and the signal voltage correction of the AMOLED pixel circuit are performed row by row.

10. The AMOLED pixel circuit according to claim 9, wherein as the driving current is relatively smaller than a normal value, the signal voltage drive circuit correspondingly corrects and raises the signal voltage; as the driving current is relatively larger than the normal value, the signal voltage drive circuit correspondingly corrects and reduces the signal voltage.

11. The AMOLED pixel circuit according to claim 9, wherein each column of pixels corresponds to one current measurement circuit.

* * * * *